United States Patent [19]

Malhotra

[11] Patent Number: 4,677,898

[45] Date of Patent: Jul. 7, 1987

[54] HAND FIREARM

[75] Inventor: Satish K. Malhotra, Steyr, Austria

[73] Assignee: Steyr-Daimler-Puch AG, Vienna, Austria

[21] Appl. No.: 831,154

[22] Filed: Feb. 19, 1986

[30] Foreign Application Priority Data

Feb. 20, 1985 [AT] Austria ..... 504/85

[51] Int. Cl.[4] ..... F41D 3/00

[52] U.S. Cl. ..... 89/187.01

[58] Field of Search ..... 89/173, 180, 182, 183, 89/187.01

[56] References Cited

U.S. PATENT DOCUMENTS

| | | | |
|---|---|---|---|
| 1,338,866 | 5/1920 | Payne | 89/187.01 |
| 1,340,891 | 5/1920 | Graham . | |
| 1,363,809 | 12/1920 | Payne | 89/187.01 |
| 1,425,810 | 8/1922 | Thompson . | |
| 2,270,683 | 6/1942 | Janecek . | |
| 2,365,389 | 12/1944 | Browning . | |
| 3,213,558 | 10/1965 | Horsrud | 42/17 |

FOREIGN PATENT DOCUMENTS

| | | |
|---|---|---|
| 300108 | 6/1920 | Fed. Rep. of Germany . |
| 176389 | 4/1935 | Switzerland . |

*Primary Examiner*—Stephen C. Bentley

*Attorney, Agent, or Firm*—Marmorek, Guttman & Rubenstein

[57] ABSTRACT

The breech block of a hand firearm consists essentially of a breech block carrier being displaceable against the force of a return spring, and a breech block being supported for relative movement in the breech block carrier and being traversed by an ignition pin. The barrel of the hand firearm is firmly connected with the stock or similar part thereof. In order to reduce the return speed of the breech block without increasing its mass, the breech block carrier is provided, behind the closing element being longitudinally displaceable in the same, with a latch which is located in the plane of symmetry of the lock and can be displaced transversely to the direction in which the barrel extends. In closed position of the breech block, the latch is in contact, with little play, by means of a rearward oblique face thereof, with a counter face of the stock or the like part. Moveover, the latch and the breech block have faces of equal slope adapted for cooperation as a pair of "inclined planes".

3 Claims, 4 Drawing Figures

HAND FIREARM

BACKGROUND OF THE INVENTION

This invention relates to a hand firearm (small arm) comprising a breech block or lock consisting essentially of a sliding element or breech block carrier displaceable against the bias of a locking or return spring and a closing element or breech block traversed by an ignition pin or primer, being supported in the breech block carrier and movable relative thereto, as well as a barrel firmly connected with a stock or the like.

In hand firearms, having a breech block which is movable against the force of a return spring, the return speed (recoil) is inversely proportional to the mass of the breech block, in accordance with the theorem of momentum. Therefore, in order to decrease the return speed, it is necessary to increase the mass of the breech block. However, this is impracticable in view of the tendency of the decreasing weight and dimensions of small arms. Hence, when the mass of the lock is reduced, an increased return speed is to be expected, which means a considerably augmented energy of recoil (kick), which increases with the square of the return speed, and is extremely detrimental when shooting off the hand arm. In a known hand firearm, the return spring is mounted in the breech block carrier for relative displacement thereto in longitudinal as well as in transverse direction and is supported in the breech block carrier via a rocking lever. The breech block abuts initially without play against an oblique stop of the stock or the like. In order to delay the rising of the breech block, or, respectively, its lifting off this stop, which movement initially results in a desirable transmission of force to the stock or the like at the instant of ignition, use is made of the inertia of the breech block carrier by way of the rocking lever. However, this entails the drawback that the return speed of the slider is additionally increased by the rocking lever, so that the recoil is not reduced.

OBJECTS AND SUMMARY OF THE INVENTION

It is, therefore, an object of the invention to provide a hand firearm of the initially described kind, in which the return speed of the breech block is reduced without increase of its mass, thereby making the firing of the arm more comfortable.

This object and others that will become apparent from the following description, are attained in accordance with the invention by providing a firearm of the initially described kind in which the breech block carrier comprises a transversely displaceable latch located behind the breech block, being longitudinally displaceable in the breech block carrier, in the plane of symmetry of the breech block. In the "locked" position of the breech block, this latch is in contact by means of an inclined rearward face thereof with a counterface of the stock or the like, with little play, the latch and the breech block having faces of the same inclination adapted for cooperating with each other as "inclined planes".

When ignition occurs, the breech block together with the breech block carrier will initially move backward, against the force of the return spring, by a very small length which results from the play between the rearward oblique face of the latch, on the one hand, and the counterface of the stock or the like, on the other hand.

This very small return path, which must also be followed by the cartridge case being seized in the breech block, suffices for offering to the latch, which had been held immovable up to this point, a possibility for displacement in its guide.

Therefore, during the further return movement of the breech block carrier, the latch will be urged away from the stock transversely to this movement. However, due to the faces, cooperating with one another as a pair of "inclines planes", of the latch and the breech block, the breech block and the cartridge shell is pressed forward against the gas pressure prevailing in the barrel. This advancing pressure affords a corresponding dissipation of energy which leads to a considerably reduced return speed, and, a reduced energy of return travel (recoil) of the breech block, so that the user's arm can be held more quietly.

A particularly suitable construction of the breech block is achieved, in accordance with a preferred feature of the invention, by providing in the faces of the latches cooperating as "inclined planes" a slot which ascends obliquely from the front toward the rear. A nose member arranged at the rear-side of the breech block and ascending obliquely with the same slope, is adapted to engage with fit in this slot.

BRIEF DESCRIPTION OF THE DRAWINGS

Further objects and advantages of the hand firearm according to the invention will become apparent from the further description of a preferred embodiment thereof making reference to the accompanying drawings in which.

DETAILED DESCRIPTION OF THE EMBODIMENTS SHOWN IN THE DRAWINGS

Figure 1:
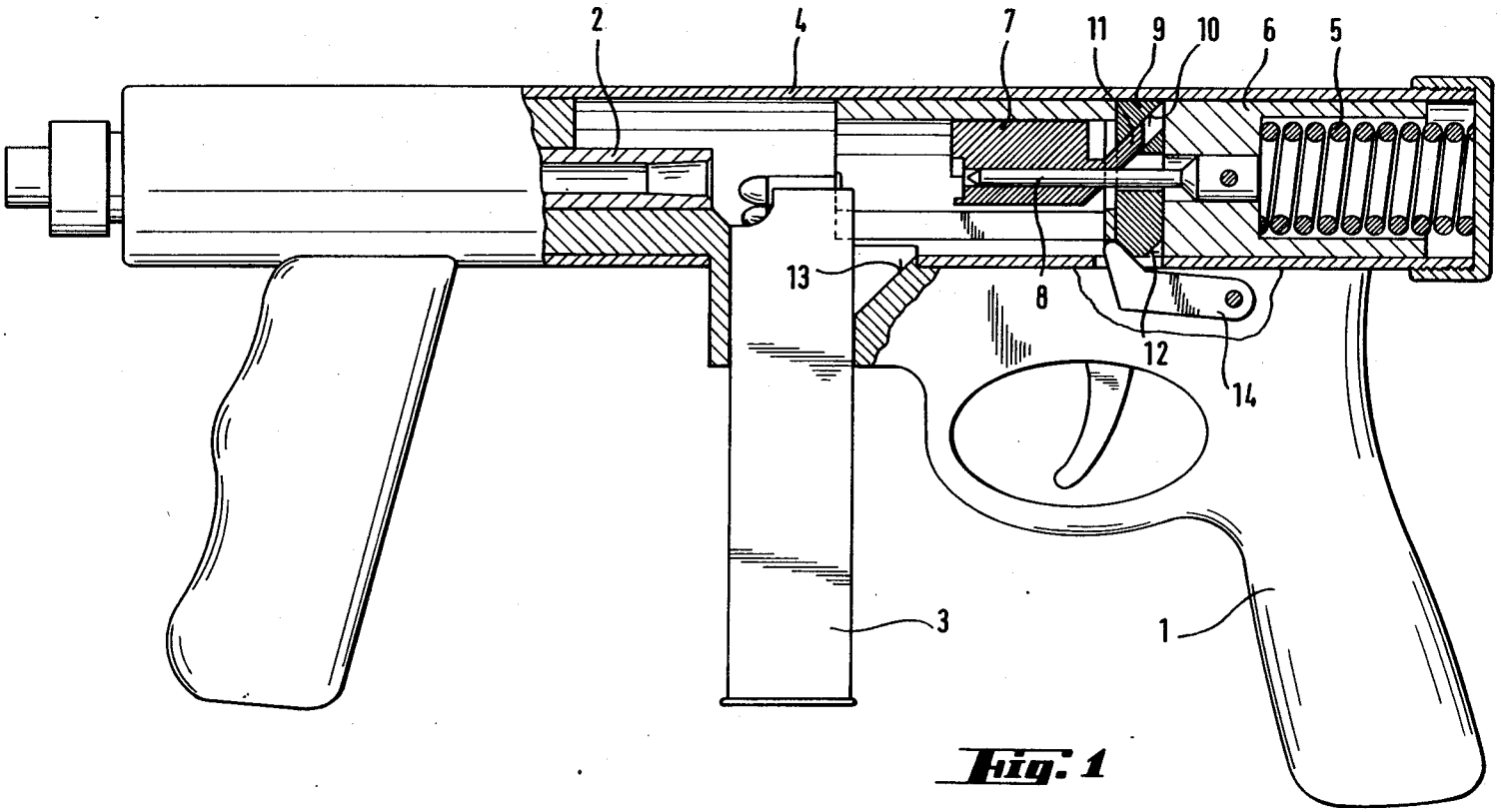
FIG. 1 shows schematically in partially cut-away lateral view a preferred embodiment of a sub-machine gun according to the invention, with the parts essential to the latter being visible in cocked position.
Figure 2:
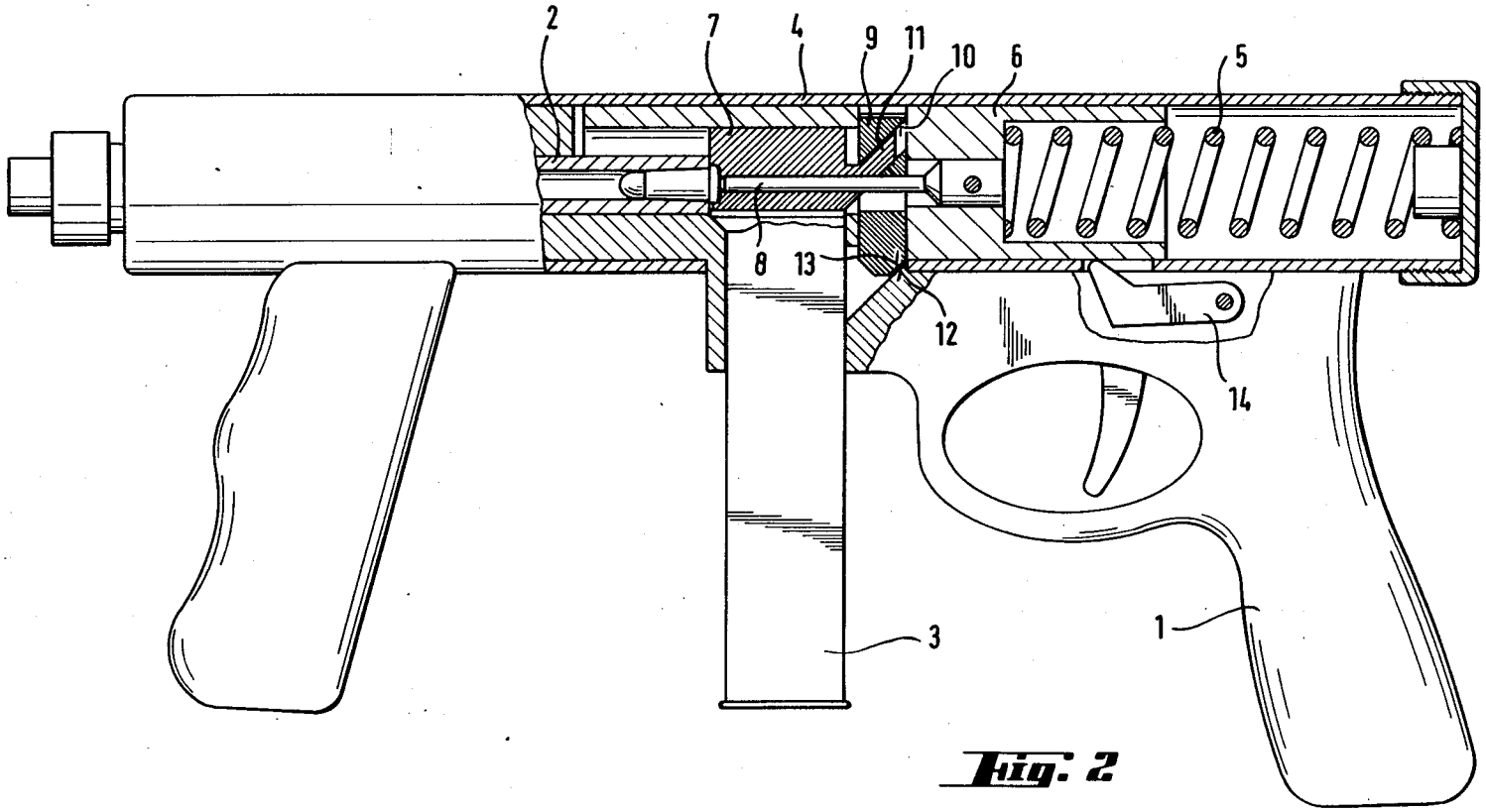
FIG. 2 shows in the same manner of illustration the same embodiment as in FIG. 1, but with the parts at the moment of ignition.

The barrel 2 of a sub-machine gun is firmly connected with the stock 1 thereof, while reference numeral 3 designates the cartridge magazine and 4 a sleeve of the gun casing, in which the breech block can slide forward and backward. The lock consists of a breech block carrier 6 being displaceable against the bias of a return spring 5, and of a breech block 7 which is arranged in the breech block carrier 6 for longitudinal displacement relative to the latter. The breech block 7 is traversed by an ignition pin 8 which is firmly connected with the breech block carrier 6.

In accordance with the invention, the slider 6 is provided, behind the breech block, with a transversely displaceable latch 9 located in the plane of symmetry of the lock. The latch 9 is provided with slot defined by faces (10,10') which ascends obliquely from the front to the rear. A nose member 11 being arranged at the rear side of the breech block 7 and ascending at the same inclination as the slot 10 is provided with faces (11*a*, 11*a'*) which are adapted to engage the latter. Moreover, the latch 9 has a rearward oblique face 12 extending parallel with the slot 10, for which face a corresponding counterface 13 is provided at the stock 1.

Figure 3:
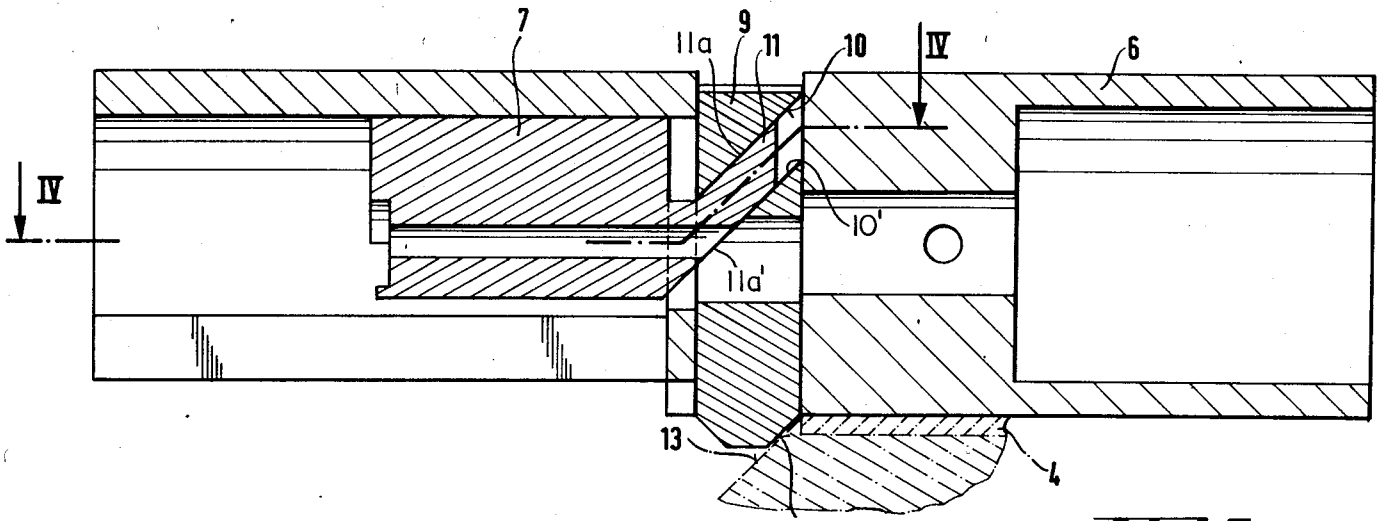
FIG. 3 is a vertical sectional view, on an enlarged scale, of the breech block and latch in the positions shown in FIG. 2.
Figure 4:
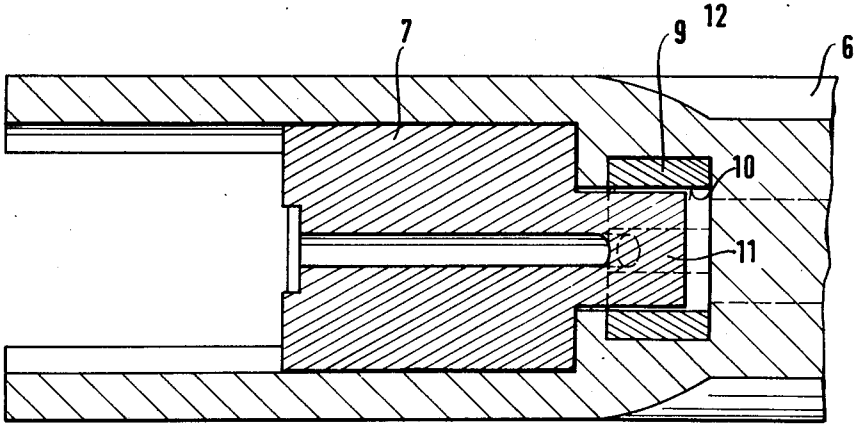
FIG. 4 is a sectional view of the same parts taken in the plane indicated by IV—IV in FIG. 3.

When the trigger is actuated with the parts in the position shown in FIG. 1, a catch or releasing lever 14 will set free the entire lock 6,7 and the latter can now be thrust forward by the force of the slackening return spring 5, with the breech block 7 taking along a cartridge from the magazine 3 and inserting the same into the cartridge chamber of the barrel 2. The latch 9 will slide downward, due to the then occurring relative movement of the breech block 7 in the breech block carrier 6, and will become supported in the "closed" position, with little play (shown exaggerated in FIG. 3) with its rearward oblique face 12 on the counter face 13. At the end of the "closing" movement, ignition has been effected by means of the ignition pin 8, and, due to the play between the faces 12 and 13 being very small, there will follow a common backward movement of the breech block carrier 6 and the breech block 7. This small movement is sufficient for enabling a lifting of the latch 9, which had been blocked earlier as the breech block 7 could not move forward due to its abutment against the rearward barrel end. The lifting of the latch 9 will now cause the desired forward thrust of the breech block 7 as a result of the faces of the slot (10,10') 10 and the nose member **(11*a*,11*a*') serving as "inclined planes", against the gas pressure prevailing in the barrel 2**, and with the desired dissipation of energy.

The terms "forward" and "rearward" and the like refer to the directions toward and away from the muzzle of the firearm, respectively.

I claim:

1. A hand firearm having a forward and a rear end defined by the direction of fire, comprising a stock, a barrel attached to said stock, said barrel defining a longitudinal axis of said firearm along said direction of fire, a return spring located at the rear end of said firearm and being aligned with said longitudinal axis, a breech block carrier located forward of said drum spring and along said longitudinal axis, said breech block carrier being displaceable against the biasing force of said return spring, a breech block received within said breech block carrier, said breech block being operable between open and closed positions, said breech block being displaceable along said longitudinal axis relative to said breech block carrier, an ignition pin traversing said breech block, latch means disposed on said breech block carrier, said latch means located to the rear of said breech block along said longitudinal axis and in a plane of symmetry of said breech block, said latch means being displaceable along said longitudinal axis and in a direction transverse to said longitudinal axis, said latch means having a rearward oblique face, said stock of said firearm including a forward oblique counterface adapted to be in registry with said face, said face and said counterface having the same degree of obliquity, said face and said counterface opposing each other with a small amount of play when said breech block is in the closed position, said latch means moving in said transverse direction when ignition of said firearm is effected and said face and counterface come into contact with each other, said breech block, said breech block carrier, and said latch means carrying out a joint recoil movement when ignition of said firearm is effected.

2. The firearm of claim 1, wherein said latch means includes a rearwardly ascending slot, and said breech block includes a rearwardly ascending nose member having substantially the same angle of inclination as said slot, said nose member being slidably received within said slot.

3. The firearm of claim 1, wherein said stock includes a releasing lever and said latch means has a forward oblique face, said releasing lever engaging said forward oblique face when said breech block is in the open position.

* * * * *